United States Patent [19]

Zimmerman et al.

[11] 4,040,278

[45] Aug. 9, 1977

[54] METHOD OF AND APPARATUS FOR REMOVING BRINE FROM HIDES

[75] Inventors: John E. Zimmerman; Richard M. Reis, Sr., both of Janesville, Wis.

[73] Assignee: Northern Conveyor & Manufacturing Corporation, Janesville, Wis.

[21] Appl. No.: 751,732

[22] Filed: Dec. 17, 1976

[51] Int. Cl.[2] ..... C14B 1/06

[52] U.S. Cl. ..... 69/42; 69/21; 100/159

[58] Field of Search ..... 69/42, 43, 44, 21; 100/159, 160

[56] References Cited

U.S. PATENT DOCUMENTS

| | | | |
|---|---|---|---|
| 1,489,486 | 4/1924 | Dillman | 100/159 |
| 2,094,761 | 10/1937 | Stehling | 69/42 |
| 2,932,185 | 4/1960 | Bode | 69/42 |
| 2,949,760 | 8/1960 | McCartney et al. | 69/44 X |
| 3,024,639 | 3/1962 | Lewis | 69/42 |
| 3,814,009 | 6/1974 | Davis et al. | 100/159 |

*Primary Examiner*—Alfred R. Guest

*Attorney, Agent, or Firm*—Ira Milton Jones & Associates

[57] ABSTRACT

A chain conveyor advances brine soaked hides hanging from hooks on the conveyor to a wringer consisting of a pair of vertically oriented pressure loaded power-driven rolls, and draws the hides through the wringer with the lengthwise dimension of the hides substantially horizontal.

13 Claims, 5 Drawing Figures

Fig. 4
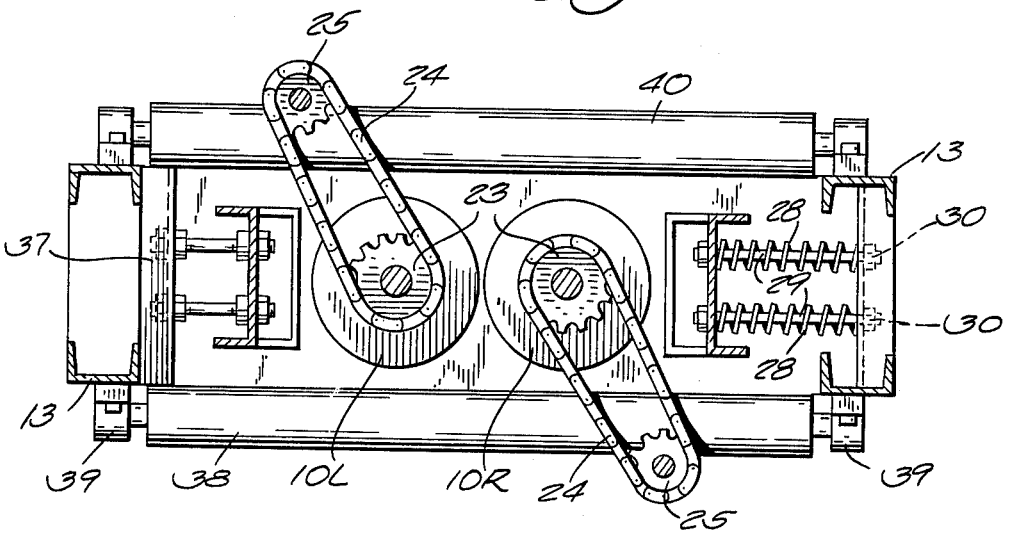
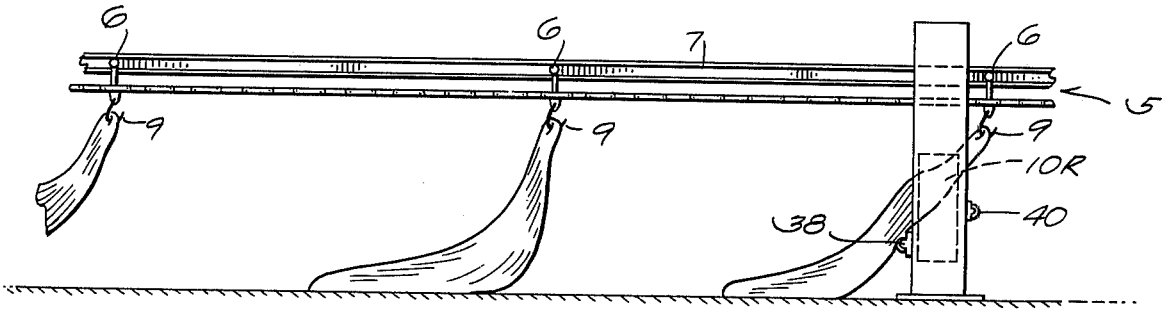
Fig. 5

METHOD OF AND APPARATUS FOR REMOVING BRINE FROM HIDES

In a broad sense, this invention relates to the tanning art, but more specifically it is concerned with the treatment of hides before they are received by the tannery. That preparatory treatment is done either by the packing houses where the hides are stripped from the slaughtered animals, or by hide processors who collect fresh "green" hides from a number of small packers who lack the capital needed for investment in hide processing equipment, and haul the hides to their plants where they perform the operations necessary to prepare them for shipment to the tannery.

Since the economics of meat packing has considerably decentralized the industry and continues to do so, the number of such small packers has been increasing, with the result that the hide processors are playing an evermore important role in the chain between the stripping of the hides from the slaughtered animals to the conversion of those hides into leather. Accordingly, any improvement advantageous to the hide processors is bound to produce significant economic benefits.

Whether the preparation of hides is done by the packer or the hide processor, it includes removing the flesh, fat and gelatinous material from the flesh side of the hides by an operation known as fleshing — but, perhaps more accurately, "defleshing" — and "curing" to rid the hides of any bacteria that would spoil the hides before they reached the tannery.

If the preparation is done by the packer, the hides stripped from the slaughtered animals are immediately dropped down a chute that leads to a cold water bath by which blood and dirt are washed from the green hides. From that bath, the hides are taken to a fleshing machine of the type covered by the Bode U.S. Pat. No. 2,932,185 issued Apr. 12, 1960 to the Chas. H. Stehling Company, which successively removes manure and caked dirt from the hair side of the hides and defleshes the other side. The defleshed hides are then cured in a salt brine, put through a wringing machine which heretofore was like that of the Stehling U.S. Pat. No. 2,094,761, graded and palletized for shipment to the tannery.

If the hide processor prepares the hides, the green hides which he collects daily from a number of small packers are immediately thrown into brine to kill any bacteria that might infest the hides, bearing in mind that they have not been defleshed and, despite all attempts to avoid it, may have been delayed in reaching the processor's plant.

When the fleshing operation is done before the curing, as it is by the packers, the fat, flesh and gelatinous material removed from the hides is not contaminated by the salt of the brine. Accordingly, that material commands a relatively high price as an ingredient of poultry food and other products that may be benefited thereby; but where — as in the case of the hide processor — the hides are defleshed after they leave the brine tank, the fleshy material removed from the hides has so high a concentration of salt that it cannot be used as an ingredient of poultry food and is often virtually useless.

While the obvious solution to this predicament would be removal of the brine — or at least as much as possible from the hides before they are passed through the defleshing machine — heretofore there has been no satisfactory way of doing that. Wringing machines such as that of the aforesaid Stehling patent can not be used for the purpose because the soft slimy material on the flesh side of the unfleshed hides balls up on the felt sleeves of those machines and so greatly interferes with the functioning of the machines as to render them useless. The hide processor thus has been saddled with the economic loss involved in having to sell the fleshings at a price far less than they would command if not saturated with salt, and in some cases of extreme salt contamination, of having to pay for the removal of that material.

It is evident, therefore, that a need has existed for some way of economically removing brine from the cured hides. This invention supplies that need. It achieves that objective through the provision of a practical wringer that is not affected by the presence of gelatinous material on the unfleshed hide, and a novel way of passing the hides, dripping with brine, through the wringer.

Not only does this invention eliminate the economic loss that is occasioned by a significant concentration of salt in the fleshings, but it also reclaims much of the brine that otherwise would be lost. Where the invention has been put in practice, as much as eight and one-quarter pounds of brine has been removed from each average sized hide.

A very significant feature of the invention resides in the fact that the passage of the wet hides through the wringer is accomplished entirely without manual attention. This feature makes the machine of this invention attractive to the packer as well as the hide processor because wringers of the Stehling type, which have been used by packers to remove water and brine from the defleshed and cured hides, require manual handling of the hides, which of course constitutes a serious labor cost.

The manner in which the invention accomplishes its objectives will be readily understood and appreciated from the detailed description of the illustrated embodiment of the invention presented hereinafter, but — as a prelude to that more specific undertaking — the following brief statement or exposition may be helpful. Thus, in accordance with the invention, a conveyor constrained to travel along a defined path that includes an elevated substantially horizontal stretch and has spaced apart hide supports from which the wet brine-soaked hides hang, advances those hides through a pair of power-driven pressure-loaded vertically oriented wringer rolls that are rotatably mounted with one roll at each of the opposite sides of a vertical plane containing the substantially horizontal stretch of the conveyor and the path of the hides hanging from its hide supports, so that the conveyor and the supporting structure for the paired wringer rolls coact to subject the hides to the wringing action of the rolls.

With these observations and objectives in mind, the manner in which the invention achieves its purpose will be appreciated from the following decription and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which:

FIG. 4 is a horizontal sectional view through the machine on the plane of the line 4—4 in FIG. 2; and FIG. 5 is a diagrammatic view illustrating the manner in which the wet hides are advanced towards and pulled through the machine.

Figure 1:
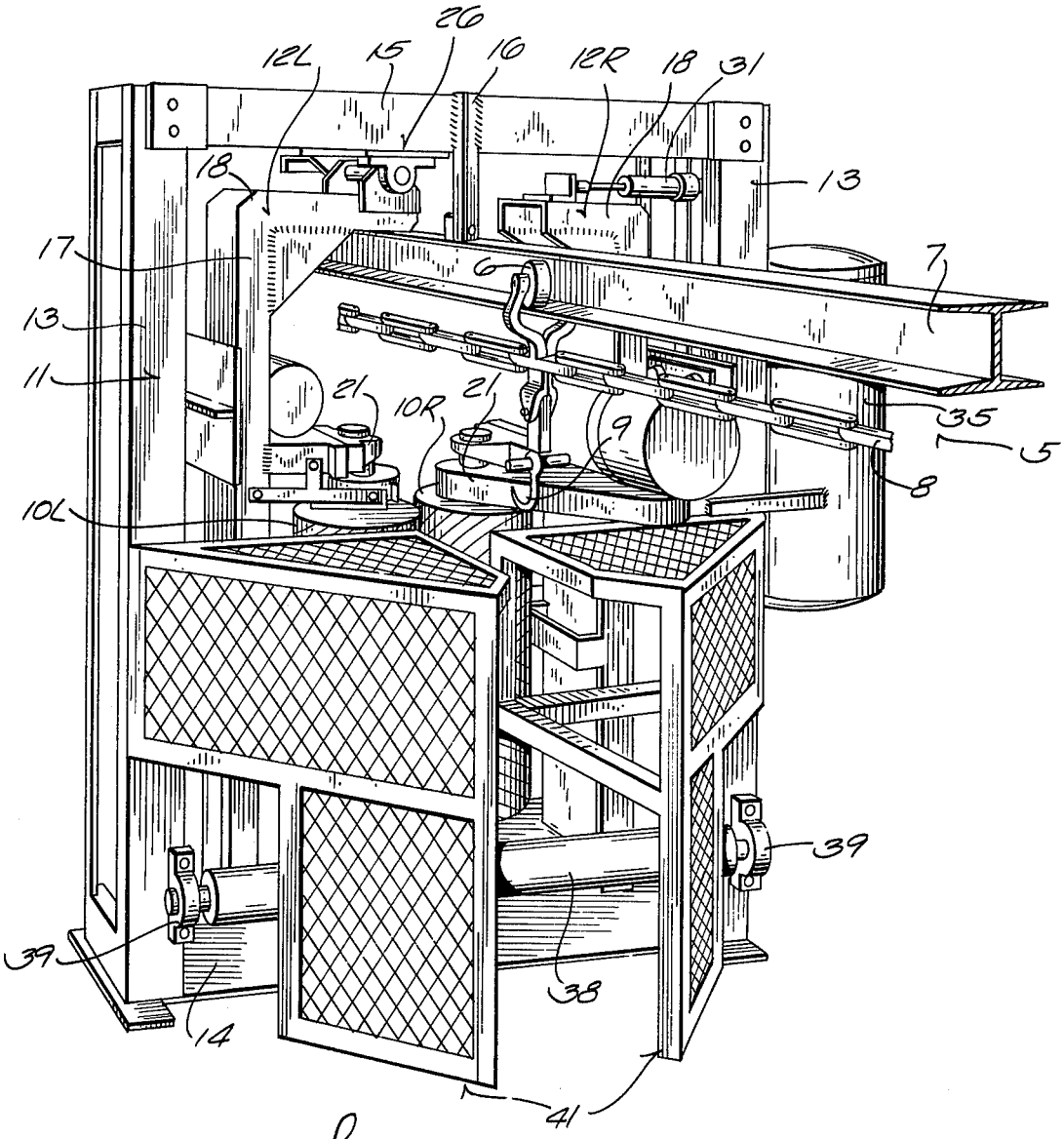
FIG. 1 is a perspective view of the machine of this invention, viewing the same from what can be considered its front.
Figure 2:
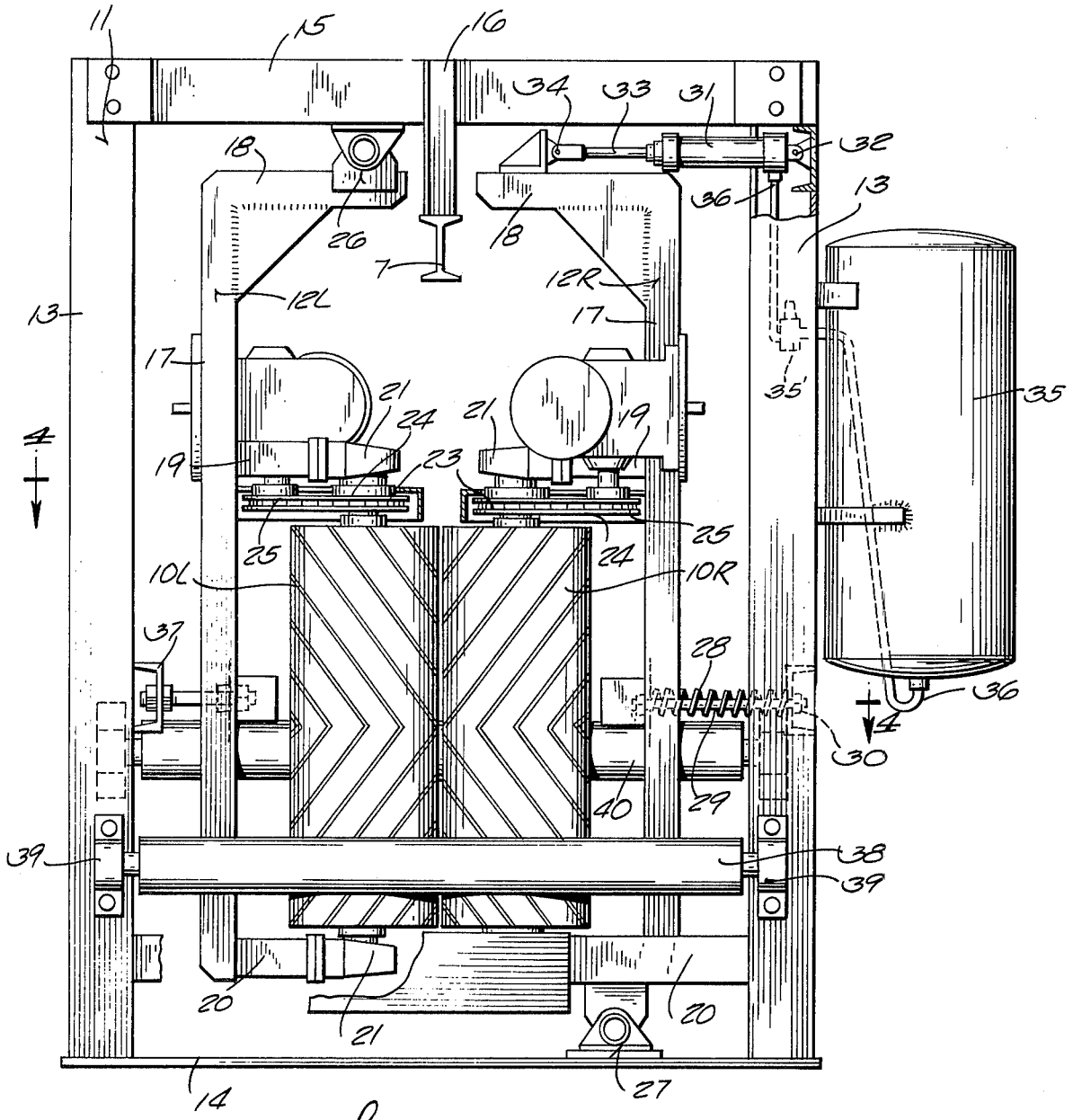
FIG. 2 is a front elevational view of the machine with part of the structure that appears in FIG. 1 omitted for clarity.
Figure 3:
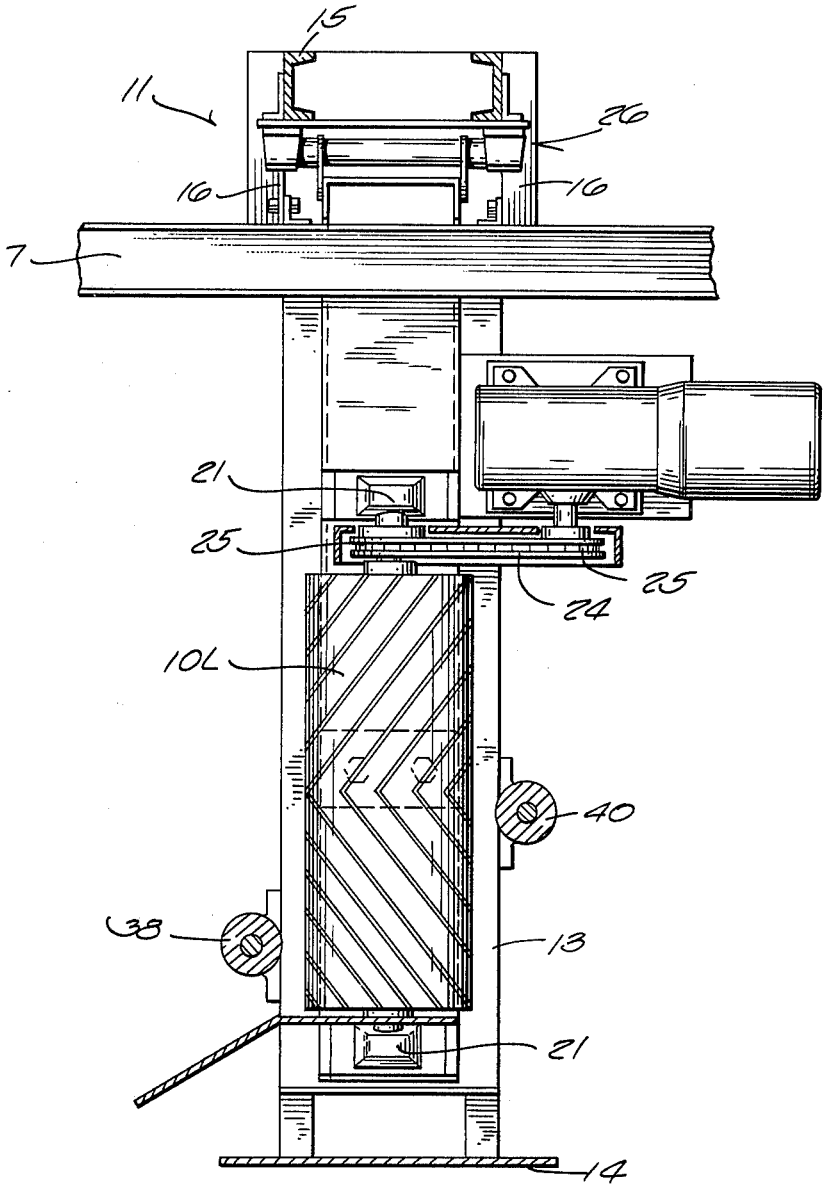
FIG. 3 is a vertical sectional view taken through FIG. 2 on the plane of the line 3—3.

Referring to the drawings, the numeral 5 designates generally a conveyor consisting of an endless chain — only a portion of which is illustrated — supported by rollers 6 riding on a track 7. The track is suitably supported at spaced points along the length thereof, and constrains the conveyor chain to travel along a defined path that includes an elevated substantially horizontal stretch identified by the numeral 8. At spaced intervals along the length of the conveyor chain, there are depending hooks 9 on which brine-soaked hides are draped.

Below the substantially horizontal stretch of the conveyor is a pair of vertically oriented pressure-loaded wringer rolls 10R–10L. These rolls are mounted in a supporting structure that comprises a rigid main frame 11 and a pair of left and right-hand sub-frames 12L and 12R, respectively. The main frame has upright side members 13 rising from a base 14 and joined at the top by a cross member 15. The horizontal stretch of the conveyor track is securely suspended from this cross member by hangers 16. Accordingly, the conveyor and the main frame of the machine are held in fixed relationship with the path of the conveyor equispaced from the sides of the frame.

The sub-frames 12L and 12R are L-shaped members with long and short legs 17 and 18, respectively, the latter being disposed horizontally and the former — vertically. Upper and lower arms 19 and 20, respectively, project inwardly from the long legs of the sub-frames and have coaxial bearings 21 mounted thereon. The shaft end portions of the rolls are journaled in these bearings, and between the upper bearing and the adjacent upper end of each roll is a sprocket 23 fixed with respect to the roll.

The sprockets 23 are drivingly connected by chains 24 with drive sprockets 25 of gear motors that are mounted on the long legs of the sub-frames above the wringer rolls. Each roll is thus power driven in the direction to grip hides hanging from the conveyor as the latter advances them to and through the machine.

Both sub-frames are hingedly connected with the main frame, the left-hand one 12L being pivoted, as at 26, to the cross member 15, and the right-hand sub-frame 12R being pivoted, as at 27, to the base 14. Attention is directed to the fact that the locations of the pivot points 26 and 27 are such that when the long legs of the sub-frames — and likewise the axes of the wringer rolls — are parallel, the rolls are equispaced from and parallel with a vertical plane containing the substantially horizontal stretch of the conveyor.

Obviously, of course, for hides being advanced by the conveyor to pass between the rolls, the gap between them must be expandable. That requirement is met by yieldingly resisting outward movement of at least one of the rolls. In the illustrated embodiment of the invention, only the roll mounted in the right-hand sub-frame 12R is capable of such movement, and — to resist that displacement — a pair of loaded compression springs 28 is confined between the long leg of the sub-frame and the adjacent upright member of the main frame. These springs are held in place by being mounted on rods 29 that have one end anchored to the sub-frame and the other end slidably received in a hole in the adjacent portion of the main frame. Nuts 30 threaded on the rods outwardly of the portion of the main frame in which the rods are slidably supported, limit the spring-produced inward motion of the sub-frame.

Coacting with the springs 28 in resisting outward displacement of the sub-frame 12R as a hide passes between the wringer rolls, is a single acting pneumatic cylinder 31 pivotally connected, as at 32, with the main frame above the short arm of the sub-frame 12R. The piston of this cylinder has its rod 33 pivotally connected at 34 with the sub-frame. Accordingly, air pressure in the cylinder resists outward movement of the sub-frame. That pressure is derived from a pressurized tank 35 with which the closed end of the cylinder is connected through a pressure regulator 35' by a hose 36. Since the connected tank and cylinder constitute a closed system, the magnitude of the pressure available to resist outward displacement of the sub-frame remains constant and is determined by the level to which the tank is pressurized.

The tank 35 is conveniently mounted on the main frame adjacent to the sub-frame 12R.

While the left-hand sub-frame 12L could also be yieldingly maintained in a predetermined position, it has been found preferable to secure it in a fixed position by interposing a strut in the form of a pair of rods 37 of adjustable fixed length, between its long arm and the adjacent left-hand upright of the main frame. The opposite end portions of these rods are threaded and, by means of nuts threaded thereon, are adjustably anchored to the main frame and the sub-frame. Hence the wringer roll mounted in the sub-frame 12L can be set at whatever angle is best suited to the hides being handled. For most purposes, that angle is vertical.

Use of a strut to hold the sub-frame 12L in its selected position, as distinguished from a more rigid structure, has the advantage of providing a safety factor that protects the machine against the consequences of the passage between the wringer rolls of a hide-carried imcompressible object too large to be accommodated by the yieldability in the force with which outward displacement of the right-hand sub-frame is resisted. When that happens, the strut simply bends and, while a bent strut must be replaced, that is far more acceptable than repairing structure that might otherwise have broken.

It is a feature of the invention that the path of the hooks 9 of the conveyor chain on which the hides are hung is but a short distance above the upper ends of the wringer rolls. That being the case, only that very small portion of the hide that spans the distance between the upper ends of the rolls and the hook by which it is being advanced escapes being acted upon by the wringer rolls. All of the rest of the hide is successively squeezed between the rolls by virtue of the way it is drawn into and through the wringer.

The manner in which the hides are drawn through the wringer is therefore a significant feature of the invention. As depicted in FIG. 5, the vertical dimension of the wringer rolls, i.e. the axial length thereof, is considerably less than the length of the average hide. To illustrate, while the lengthwise dimension of a cow hide may be as much as 12 feet, the axial dimension of the wringer rolls is only 2 feet; and since the path of the conveyor hooks from which the hides hang is directly above the upper ends of the wringer rolls and the lower ends thereof are near the base of the machine, hides being conveyed to the wringer rolls are dragged along the floor and thus approach the wringer rolls with their lengthwise dimension substantially horizontal.

To assure that all but the very small part of the hide between the conveyor hook and the upper ends of the wringer rolls will be subjected to the wringing action of the rolls, a lifting member 38 extends horizontally across the front of the main frame and hence upstream of the wringer rolls, with respect to the direction in which the conveyor travels, at an elevation slightly above the bottom of the wringer rolls. While this lifting member could be simply a rounded plate or pipe, it is preferably in the form of a roller freely journaled in bearings 39 mounted on the front edge of the upright side members of the main frame.

Although not absolutely essential, a second hide-lifting member, again preferably in the form of a freely rotatable roller 40, is similarly mounted across the rear of the main frame at an elevation higher than that of the front roller 38.

The presence of these two rollers assures that even the very last trailing portion of a hide moving through the machine will be wrung out.

Inasmuch as the right-hand sub-frame 12R is hinged to the main frame at the bottom, it follows that as the right-hand roll is displaced from its initial vertical orientation by a hide passing between the rolls, the resulting increase in the space between the rolls is progressively wider towards the top. That condition coacts with the lifting rollers to assure that no part of the hide will hang down below the bottom of the rolls; but it also tends to squeeze the hide out of the top of the space between the rolls. To guard against that eventuality, the surface of the rolls has a high coefficient of friction, which is conveniently provided by covering each roll with a rubber-like sheath having a traction imparting pattern or texture on its outer surface.

Although the hides hanging from the conveyor hooks will generally accommodate themselves to the wringer rolls as they enter the machine, to assure that result, a pair of guides 41 is mounted at the front of the main frame to form an inwardly converging guideway leading to the bite of the wringer rolls.

From the foregoing description, it should be apparent that this invention is a boon to the hide processor for, with it, he can rid the hides of the brine that heretofore made it impossible for him to command a significant price for the fleshings removed from the hides by the defleshing operation; and especially so because the wringing of the excess brine from the hides is accomplished without manual handling of the hides beyond hanging them on the conveyor hooks as they pass on their way to the wringer. In addition, the recovery of more than 8 pounds of brine from each hide represents a saving. Obviously, the brine wrung from the hides can be channeled to a collecting sump by a gutter or the like formed in or on the floor.

For the packer this invention presents an opportunity to reduce his labor costs since it obviates the manual handling of the hides necessitated in the use of the only wringing machines heretofore available.

Those skilled in the art will appreciate that the invention can be embodied in forms other than as herein disclosed for purposes of illustration.

For instance, though the machine has been illustrated and described as having its frame rigidly connected to the conveyor by which the hides are advanced to and carried from the machine, that fixed relationship is not essential. Instead, the machine could be designed as a portable unit capable of attachment to hide pulling conveyors of any suitable type.

Also, to accommodate installation restrictions, the pivotal connections 26 and 27 between the sub-frames and the main frame can be located at either the top or bottom on either the right or the left side of the machine. Obviously, of course, such relocation of the pivot points would entail appropriate and corresponding rearrangement of the adjuncts to the sub-frames, as for instance the pressure tank 35.

The invention is defined by the following claims:

We claim:

1. The method of removing brine from wet brine-soaked hides, which comprises:

A. hanging the hides on hooks of an elevated conveyor;

B. by means of the conveyor, advancing the hides along a substantially horizontal path towards and through a pair of substantially vertically oriented pressure loaded power-driven wringer rolls with the part of each hide that is engaged by its respective conveyor hook moving in a path just slightly higher than the upper end of the wringer rolls; and C. lifting the trailing portion of each hide as it is about to be clamped between the wringer rolls, to an elevation sufficiently above the lower end of the wringer rolls to assure that all but the very small part of the hide that spans the distance between the upper end of the wringer rolls and the path of the conveyor hooks will be subjected to the wringing action of the rolls.

2. A machine for removing brine from hides in preparation for subsequent operations to be performed on the hides, comprising:

A. a conveyor constrained to travel along a defined path which includes an elevated substantially horizontal stretch, said conveyor having hide supports by which brine-soaked hides are carried through the machine;

B. a pair of power driven pressure-loaded wringer rolls; and

C. supporting structure rotatably mounting said paired wringer rolls with their axes substantially vertical and one roll at each of the opposite sides of a vertical plane containing said substantially horizontal stretch of the conveyor and of the path of hides hanging from the hide supports as the latter traverse said substantially horizontal stretch, so that the conveyor and the supporting structure for the paired wringer rolls coact to subject the hides to the wringing action of the rolls.

3. The machine defined by claim 2, wherein said supporting structure so locates the paired wringer rolls that the upper ends of the latter are but a short distance below the adjacent portion of the path of the hide supports, and further characterized by:

hide lifting means located in the path of the pendent portions of hides hanging from the hide supports as the hides begin their passage between the rolls, said hide lifting means being at an elevation above but near that of the lower end of the wringer rolls so that said hide lifting means coacts with the close proximity of the upper ends of the paired wringer rolls to the path of said hide supports to assure that substantially all portions of the hides are subjected to the action of the wringer rolls.

4. The machine defined by claim 3, wherein said hide lifting means comprises a freely rotatable horizontal roller directly upstream of the paired wringer rolls, with respect to the direction in which the conveyor travels.

5. The machine defined by claim 4, further characterized by a second freely rotatable horizontal roller directly downstream of the wringer rolls, with respect to the direction in which the conveyor travels, at an elevation between the upper and lower ends of the wringer rolls.

6. The machine defined by claim 5, wherein said second freely rotatable roller is at an elevation higher than that of the upstream roller.

7. The machine defined by claim 2, wherein said supporting structure comprises:

A. a rigid main frame having upright side members joined by upper and lower cross members;

B. a sub-frame for each of said paired wringer rolls, said sub-frames having top and bottom ends;

C. bearing means on each of said sub-frames in which the opposite ends of the wringer rolls are journaled and by which the rolls are connected with their respective sub-frames;

D. means fixedly mounting one of the sub-frames in said rigid main frame with the ends of the sub-frame adjacent to the cross members of the main frame;

E. means connecting the other sub-frame with the main frame with the ends thereof adjacent to the cross members of the main frame and for movement thereof towards and away from said first identified sub-frame; and F. yieldable force producing means reacting between said last named sub-frame and the rigid main frame to yieldingly urge its roll towards the other roll and thereby provide pressure loading for the paired wringer rolls.

8. The machine defined by claim 7, wherein said means for connecting said other sub-frame with the rigid main frame comprises hinge means joining one end of said sub-frame with the adjacent cross member of the main frame, whereby said other sub-frame is hingedly movable, and wherein said yieldable force producing means includes 1. a single acting pressure cylinder arranged to react between said hingedly movable sub-frame and the main frame, 2. a closed pressure vessel containing air under pressure, and 3. a pressure conduit communicating said pressure cylinder with the pressure vessel.

9. The machine defined by claim 8, further characterized by means on the surface of said wringer rolls imparting a high coefficient of friction thereto to thereby resist sliding of the hides lengthwise of the rolls as passage of the hides therebetween spreads the rolls apart and tilts the hingedly movable sub-frame away from the fixedly mounted sub-frame.

10. The machine defined by claim 8, wherein said force producing means further includes a compression spring reacting between said hingedly movable sub-frame and the rigid main frame.

11. The machine defined by claim 7, wherein said means fixedly mounting the first identified sub-frame in the rigid main frame comprises hinge means connecting one end of that sub-frame with the adjacent cross member of the main frame, and a strut connected between the rigid main frame and a point on said sub-frame that is spaced from said hinge means.

12. The machine defined by claim 11, wherein the effective length of said strut is adjustable to enable the orientation of said first identified sub-frame and the roll carried thereby to be varied with respect to the main frame, and wherein said strut is capable of withstanding only a predetermined compression force so that it fails and premits separation of the wringer rolls to allow the passage therebetween of a hide-carried incompressible object too large to be accommodated by the yieldability of the force producing means reacting between the second identified sub-frame and the main frame.

13. A machine for wringing brine-soaked hides comprising:

A. a pair of power driven pressure-loaded wringer rolls;

B. supporting structure rotatably mounting said wringer rolls with their axes substantially vertical;

C. a conveyor movable along a substantially horizontal path located above the paired wringer rolls; and D. hide supporting means on said conveyor adapted to have brine-soaked hides hung therefrom to be advanced to the paired wringer rolls and then, after having brine wrung therefrom, carried from the machine.

* * * * *